US009908598B1

(12) United States Patent
Toth

(10) Patent No.: US 9,908,598 B1
(45) Date of Patent: Mar. 6, 2018

(54) BUOYANCY COMPENSATING DEVICE INCLUDING AN IMPROVED PULL KNOB FOR VENTING EXCESS GAS

(71) Applicant: Huish Outdoors, LLC, Salt Lake City, UT (US)

(72) Inventor: Douglas J. Toth, San Clemente, CA (US)

(73) Assignee: Huish Outdoors, LLC, Salt Lake City, UT (US)

( * ) Notice: Subject to any disclaimer, the term of this patent is extended or adjusted under 35 U.S.C. 154(b) by 0 days.

(21) Appl. No.: 15/341,928

(22) Filed: Nov. 2, 2016

(51) Int. Cl.
*B63C 11/08* (2006.01)
*B63C 9/08* (2006.01)
*B63C 9/125* (2006.01)

(52) U.S. Cl.
CPC ..... *B63C 11/08* (2013.01); *B63C 9/08* (2013.01); *B63C 9/125* (2013.01); *B63C 2011/085* (2013.01)

(58) Field of Classification Search
CPC ..... B63C 11/02; B63C 11/08; B63C 11/10; B63C 11/24; B63C 11/26; B63C 11/00; B63C 11/22; B63C 9/00; B63C 9/08; B63C 9/125; B63C 9/1255
USPC ..... 441/88, 96; 405/185, 186, 187
See application file for complete search history.

(56) References Cited

U.S. PATENT DOCUMENTS 4,000,534 A * 1/1977 Cerniway ..... B63C 9/1255 405/186
4,685,890 A * 8/1987 Edwards ..... B63C 9/1255 441/94
4,887,987 A * 12/1989 Kato ..... B63C 9/1255 441/96
5,980,158 A * 11/1999 Griffiths ..... B63C 11/08 405/186
6,120,213 A * 9/2000 Stinton ..... B63C 11/08 405/186
6,431,934 B2 8/2002 Cressi
6,976,894 B1 * 12/2005 Turner ..... B63C 9/087 405/186

* cited by examiner

*Primary Examiner* — Lars A Olson
(74) *Attorney, Agent, or Firm* — Austin Rapp

(57) ABSTRACT

A buoyancy compensating device is disclosed. The buoyancy compensating device includes an air chamber for containing gas for controlling buoyancy, a vent valve for releasing the gas from the air chamber, a tube secured to a shoulder strap of the buoyancy compensating device, and a pull knob for operating the vent valve. The pull knob includes a head piece and an elongated tail piece extending from the head piece. The tail piece is extended into the tube and connected to the vent valve. The tail piece is configured to reside in the tube while the pull knob is pulled by the diver for opening the vent valve. The tail piece may be connected to a pull cord which is then connected to the vent valve. Alternatively, the tail piece may be directly connected to the vent valve.

13 Claims, 3 Drawing Sheets

BUOYANCY COMPENSATING DEVICE INCLUDING AN IMPROVED PULL KNOB FOR VENTING EXCESS GAS

TECHNICAL FIELD

This application is related to a buoyancy compensating device. More particularly, this application is related to a buoyancy compensating device having an improved pull knob for venting excess gas from the air chamber of the buoyancy compensating device.

BACKGROUND

A buoyancy control device (BCD) is a piece of diving equipment which is worn by divers to control buoyancy. A diver wears a BCD to adjust the effective weight of the diver in the water. A BCD is also called a buoyancy compensator (BC).

A BCD includes an inflatable bladder (or other similar device) that is inflatable orally or by a container of compressed gas. To rise up in the water, the bladder is filled with air, thus increasing the buoyancy of the diver. When the diver desires to sink in the water, gas is released from the bladder, thereby decreasing the buoyancy of the diver.

Divers use, for example, buoyancy compensating devices for adjusting buoyancy by the addition or release of air into the air chamber of the device. This air is usually introduced into the device by means of an inflator device, which is connected to the diver's breathing regulator and air supply via a low-pressure hose. Push button controls on the inflator device admit air to the buoyancy compensating device for positive buoyancy or vent air out for negative buoyancy. By convention, this inflator device is typically located on the left front shoulder of the device. The diver must adjust his or her buoyancy regularly because the air in the buoyancy compensating device compresses with depth, losing buoyancy as the diver descends, and conversely expands upon ascent, increasing the buoyancy.

In addition to the inflator device, there are vent valves to relieve excess pressure automatically or manually by means of a spring-loaded seal set to a specific over-pressure amount. These vent valves can be manually operated by means of a pull cord. When pulled, the pull cord pulls the vent valve away from its seat, venting air from the device. Many devices have a manual valve located behind the top right shoulder of the device, opposite the side where the inflator device is located. The pull cord attached to the vent valve travels along the edge of a right shoulder in a tube or fabric sleeve. Where the pull cord exits the tube or fabric sleeve, the pull cord terminates with a knob, ball, or some such feature that the diver can grasp and pull. Using the vent valve is usually easier and faster to manipulate than the push button inflator device.

SUMMARY

In accordance with one embodiment, a buoyancy compensating device is disclosed. The buoyancy compensating device comprises an air chamber for containing gas for controlling buoyancy, a vent valve for releasing the gas from the air chamber, a tube secured to a shoulder strap of the buoyancy compensating device, and a pull knob for operating the vent valve. The pull knob comprises a head piece and an elongated tail piece extending from the head piece. The tail piece may be extended into the tube and connected to the vent valve. The tail piece may be configured to reside in the tube while the pull knob is pulled by the diver for opening the vent valve.

The tail piece may be connected to a pull cord which is then connected to the vent valve. Alternatively, the tail piece may be directly connected to the vent valve. The tail piece may be rigid enough to maintain its shape and relative position, yet flexible enough to conform to contours of the buoyancy compensating device.

DETAILED DESCRIPTION

The embodiments of the present disclosure will be explained with reference to the drawings, wherein like parts are designated by like numerals throughout. It will be readily understood that the components of the present disclosure, as generally described and illustrated in the figures herein, could be arranged and designed in a wide variety of different configurations. Thus, the following more detailed description of the exemplary embodiments, as represented in the figures, is not intended to limit the scope of the invention, as claimed, but is merely representative of exemplary embodiments of the disclosure.

Figure 1:
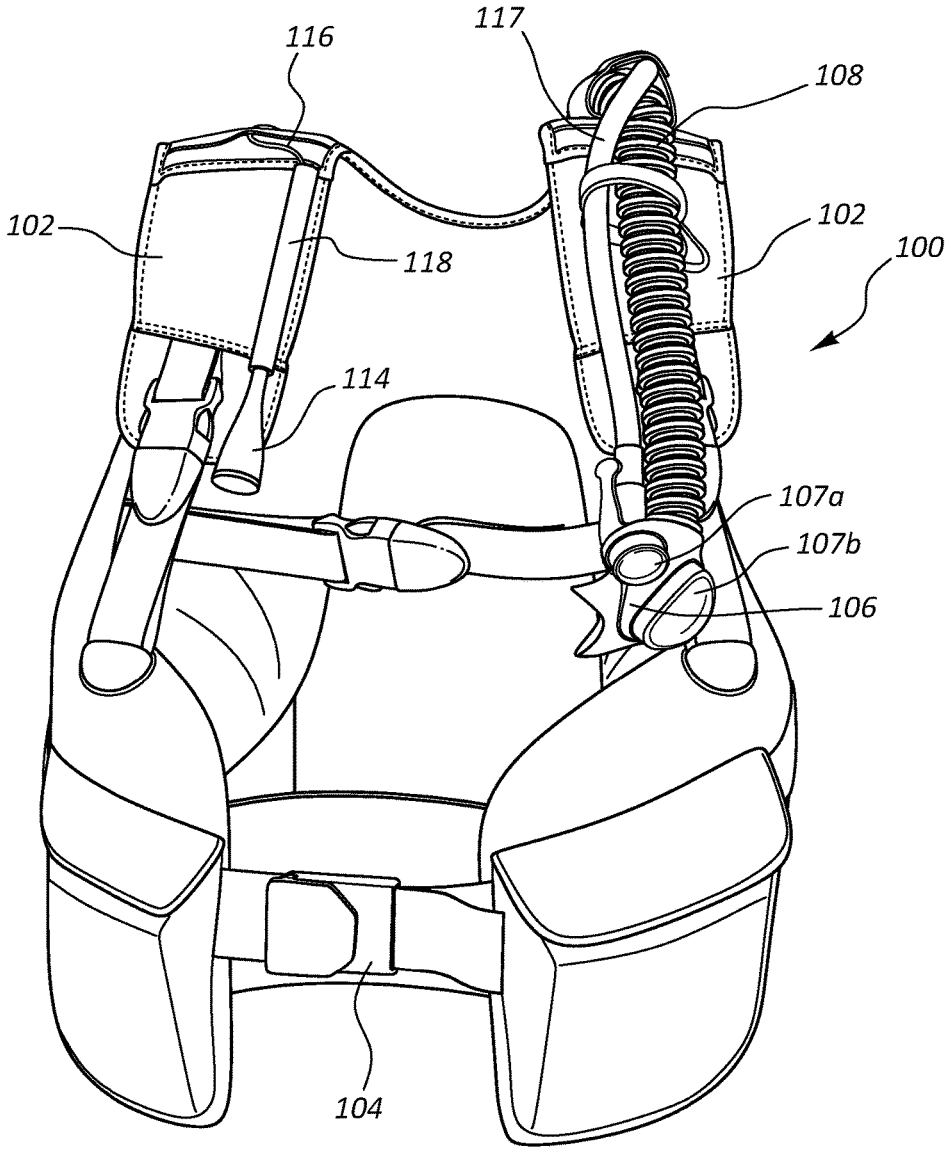
FIG. 1 shows an example of a buoyancy compensating device in accordance with one embodiment of the present disclosure.
Figure 2:
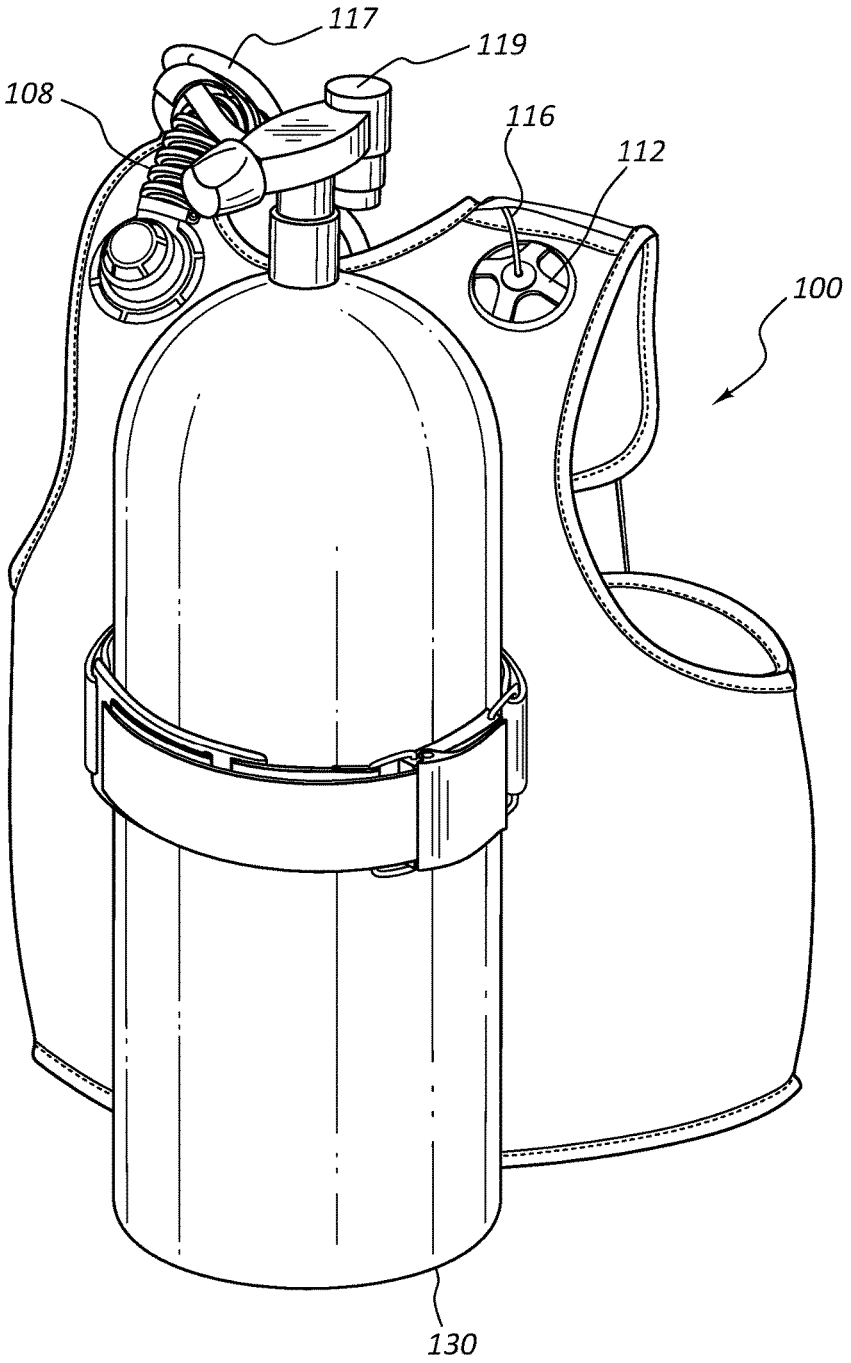
FIG. 2 shows a back side of the buoyancy compensating device of FIG. 1.

FIG. 1 shows an example of a buoyancy compensating device 100 in accordance with one embodiment of the present disclosure. FIG. 2 shows a back side of the buoyancy compensating device 100 of FIG. 1. The embodiments of the present disclosure will be explained with reference to the buoyancy compensating device 100 as shown in FIGS. 1 and 2 as an example of a BCD, but it should be noted that the embodiments disclosed herein are not limited to a jacket-type BCD as shown in the drawings, but may be applied to any type of BCD.

The buoyancy compensating device 100 includes shoulder straps 102 and a waist band 104 to secure the buoyancy compensating device 100 to a diver's torso. The buoyancy compensating device 100 includes at least one air chamber (not shown), such as a bladder, inside to contain gas, which may be added or released during the dive to control buoyancy. A diving cylinder 130 (i.e., a diving tank) may be secured to the back side of the buoyancy compensating device 100, as shown in FIG. 2. The diving cylinder 130 is a gas cylinder used to store and transport the high-pressure breathing gas required by the diver. The diving cylinder 130 may provide gas to the diver through the demand valve of a diving regulator 119.

The gas may be injected into the air chamber(s) using an inflator device 106. The inflator device 106 injects gas from a low-pressure hose 117 from the diving regulator 119 of the diving cylinder 130 or from an auxiliary cylinder to the air chamber(s) of the buoyancy compensating device 100. This may be controlled by two push buttons 107*a*, 107*b* on the inflator device 106. The smaller push button 107*a* is for inflation, and the larger push button 107*b* is for deflation. The inflator device 106 is typically installed at the end of the corrugated inflation hose 108 (i.e., a conduit from the inflator device 106 to the buoyancy compensating device 100).

A vent valve 112 may be installed on a right shoulder of the buoyancy compensating device 100, as shown in FIG. 2. The vent valve 112 allows gas to be released or to escape in a controlled fashion from the air chamber(s) of the buoyancy compensating device 100.

The vent valve 112 may be connected to a pull cord 116 so that the vent valve 112 may be operated by pulling the pull cord 116. A pull knob 114 may be attached at the end of the pull cord 116 to make it easier for the diver to grab and operate the pull cord 116. A tube or a fabric sleeve 118 (hereafter simply "tube") may be attached to a shoulder strap to support and guide the pull cord 116. Conventionally, the pull cord 116 connected to the vent valve 112 is extended to the front side of the buoyancy compensating device 100 through the tube 118.

Figure 3A:
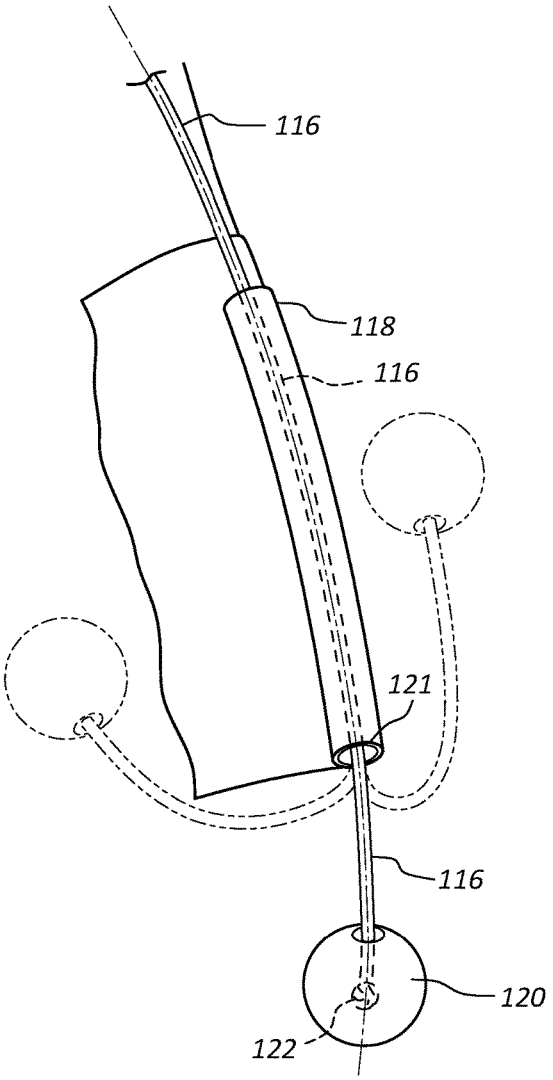
FIG. 3A shows a conventional pull cord and pull knob.

FIG. 3A shows a conventional pull cord 116 and pull knob 120. The pull cord 116 is extended through the tube 118 and a pull knob 120 is secured at the end of the pull cord 116 by forming a knot 122. The problem with the conventional pull cord 116 and pull knob 120 is that there must be sufficient cord length between the end 121 of the tube 118 and the pull knob 120 so that the vent valve 112 is not accidentally opened by normal movement of the device shoulder, which may tension the pull cord 116, opening the vent valve 112. The pull cord 116 must also be flexible to allow it to conform to the configuration of the device 100 and the remote location of the vent valve 112. The length of the pull cord 116 between the end 121 of the enclosing tube 118 and the pull knob 120 is usually about 2 inches or more. Because the pull cord 116 is flexible, the pull knob 120 may move freely and therefore the pull knob 120 may never be in the same location. As shown in FIG. 3A, the pull knob 120 is free to rotate from the end 121 of the tube 118 from which it exits. This makes it difficult for the diver to find the pull knob 120, as the pull knob 120 must be located tactilely. The pull knob 120 may not be within the visual range of the diver. The pull knob 120 may also loop the pull cord 116 around a strap or other feature of the device 100, making the pull knob 120 inoperable, or vent accidentally, causing a potentially dangerous loss of flotation.

Figure 3B:
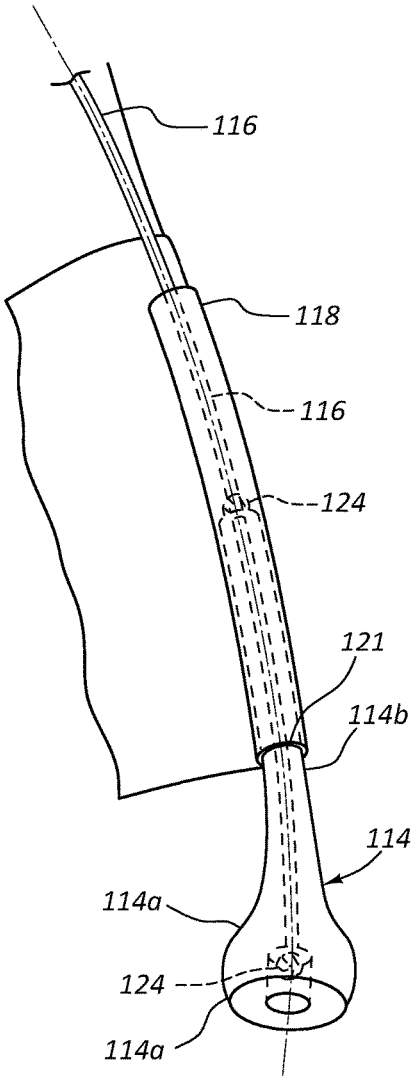
FIG. 3B shows an example of a pull cord and pull knob in accordance with one embodiment of the present disclosure.

FIG. 3B shows an example of a pull cord 116 and pull knob 114 in accordance with one embodiment of the present disclosure. The present disclosure provides an improvement to the conventional pull cord 116 and pull knob 120.

The pull knob 114 comprises a head piece 114*a* and a tail piece 114*b*. The shape and size of the head piece 114*a* may be similar to the conventional pull knob 120 for grabbing by the diver. The tail piece 114*b* is a thin, elongated member that extends from the head piece 114*a*. The tail piece 114*b* fits into the tube 118 secured to the shoulder strap in which the pull cord 116 would normally fit. The tail piece 114*b* is sufficiently long so that when the head piece 114*a* is pulled by the diver, a portion of the tail piece 114*b* still resides in the tube 118 which guides and locates the tail piece 114*b*. The tail piece 114*b* is made of semi-rigid material that is rigid enough to maintain the shape and relative position of the tail piece 114*b* while diving and operating the pull cord 116, yet still flexible to conform to contours of the flexible shoulder strap 102 of the buoyancy compensating device 100. With this embodiment, the pull knob 114 may be in a consistent location, may not get caught on other features of the buoyancy compensating device 100, and is easy to locate.

In one embodiment, as shown in FIG. 3B, the tail piece 114*b* may be attached to a pull cord 116 and the pull cord 116 may be connected to the vent valve 112. The pull cord 116 may be extended through the pull knob 114 and a knot 124 may be formed on the end of the head piece 114*a* and the tail piece 114*b*, respectively, so that the pull knob 114 may be in position relative to the pull cord 116. In accordance with another embodiment, a longer tail piece 114*b* may be used so that the tail piece 114*b* may be extended through the tube 118 and directly connected to the vent valve 112, eliminating the conventional pull cord 116 entirely.

The present disclosure may be embodied in other specific forms without departing from its structures, methods, or other characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A buoyancy compensating device, comprising:

an air chamber for containing gas for controlling buoyancy;

a vent valve for releasing the gas from the air chamber;

a pull knob for operating the vent valve, the pull knob comprising a head piece and an elongated tail piece extending from the head piece, wherein the tail piece is made of a semi-rigid material; and a tube for supporting and guiding the pull knob in place, the tail piece being extended into the tube and connected to the vent valve, wherein the tail piece is configured to reside in the tube while the pull knob is pulled by a diver for opening the vent valve.

2. The buoyancy compensating device of claim 1, wherein the tail piece is connected to a pull cord which is then connected to the vent valve.

3. The buoyancy compensating device of claim 1, wherein the tail piece is directly connected to the vent valve.

4. The buoyancy compensating device of claim 1, wherein the tail piece is rigid enough to maintain its orientation relative to the tube, yet flexible enough to conform to contours of the tube.

5. A buoyancy compensating device, comprising:

an air chamber for containing gas for controlling buoyancy;

a vent valve for releasing the gas from the air chamber;

a pull knob for operating the vent valve, the pull knob comprising a head piece and an elongated tail piece extending from the head piece;

a tube for supporting and guiding the pull knob in place, the tail piece being extended into the tube and connected to the vent valve, wherein the tail piece is configured to reside in the tube while the pull knob is pulled by a diver for opening the vent valve; and a pull cord connected to the pull knob, the pull cord being disposed within at least a portion of the elongated tail piece.

6. The buoyancy compensating device of claim 5, wherein the pull cord is connected to the vent valve.

7. The buoyancy compensating device of claim 5, wherein the tail piece is rigid enough to maintain its orientation relative to the tube, yet flexible enough to conform to contours of the tube.

8. A buoyancy compensating device, comprising:

an air chamber for containing gas for controlling buoyancy;

a vent valve for releasing the gas from the air chamber;

a pull knob for operating the vent valve, the pull knob comprising a head piece and an elongated tail piece extending from the head piece; and a tube for supporting and guiding the pull knob in place, the tail piece being extended into the tube and connected to the vent valve, wherein the tail piece is configured to reside in the tube while the pull knob is pulled by a diver for opening the vent valve;

a pull cord connected to the pull knob, the elongated tail piece of the pull knob being more rigid than the pull cord.

9. The buoyancy compensating device of claim 8, wherein the pull cord is connected to the vent valve.

10. The buoyancy compensating device of claim 8, wherein the tail piece is rigid enough to maintain its orientation relative to the tube, yet flexible enough to conform to contours of the tube.

11. A buoyancy compensating device, comprising:

an air chamber for containing gas for controlling buoyancy;

a vent valve for releasing the gas from the air chamber;

a pull knob for operating the vent valve, the pull knob comprising a head piece and an elongated tail piece extending from the head piece; and a tube for supporting and guiding the pull knob in place, the tail piece being extended into the tube and connected to the vent valve, wherein the tail piece is configured to reside in the tube while the pull knob is pulled by a diver for opening the vent valve;

a pull cord connected to the pull knob, the pull cord having a length and a width; the tail piece having a length and a width, the width of the tail piece being greater than the width of the pull cord.

12. The buoyancy compensating device of claim 11, wherein the pull cord is connected to the vent valve.

13. The buoyancy compensating device of claim 11, wherein the tail piece is rigid enough to maintain its orientation relative to the tube, yet flexible enough to conform to contours of the tube.

* * * * *